US007537015B1

(12) United States Patent
Molnar, IV et al.

(10) Patent No.: US 7,537,015 B1
(45) Date of Patent: May 26, 2009

(54) TABLE UMBRELLA APPARATUS WITH AIR TREATING SYSTEM

(75) Inventors: William F. Molnar, IV, Houston, TX (US); Mark R. Bender, Houston, TX (US)

(73) Assignee: Strategic Product Innovations, Inc., Houston, TX (US)

( * ) Notice: Subject to any disclaimer, the term of this patent is extended or adjusted under 35 U.S.C. 154(b) by 0 days.

(21) Appl. No.: 11/370,569

(22) Filed: Mar. 9, 2006

(51) Int. Cl.
*A45B 3/00* (2006.01)
*A47B 37/04* (2006.01)

(52) U.S. Cl. ..... 135/16; 108/50.12; 108/50.13

(58) Field of Classification Search ..... 135/15.1, 135/16, 910; 108/50.12, 50.13; 454/358
See application file for complete search history.

(56) References Cited

U.S. PATENT DOCUMENTS 2,641,404 A * 6/1953 Schwarz ..... 417/362
5,979,793 A * 11/1999 Louis ..... 239/128
6,298,866 B1 * 10/2001 Molnar, IV ..... 135/16
2002/0185167 A1 * 12/2002 Lin et al. ..... 135/16
2005/0161067 A1 * 7/2005 Hollins ..... 135/16

* cited by examiner

*Primary Examiner*—David R Dunn
*Assistant Examiner*—Danielle N Jackson
(74) *Attorney, Agent, or Firm*—Egbert Law Offices

(57) ABSTRACT

A table umbrella apparatus has a base, a table affixed to the base, a canopy support by the base a distance above the table, and an air treating means positioned in the base for delivering a flow of air outwardly of the base. The air treating system includes a fan, a motor drivingly connected to the fan, a reservoir positioned in the base, and a pump cooperative with the water in the reservoir for passing a flow of water across air urged by the fan. An aspen wood intake filter is positioned in the base so that the air is urged by the fan across this intake filter.

11 Claims, 7 Drawing Sheets

TABLE UMBRELLA APPARATUS WITH AIR TREATING SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to table umbrellas. More particularly, the present invention relates to table umbrella apparatus that includes systems that for passing a flow of air outwardly of the table for the purpose of heating or cooling persons seated at the table.

BACKGROUND OF THE INVENTION

In many areas of the world, large umbrellas are used in conjunction with tables for the purpose of providing shade to those dining or drinking at the table. These table umbrellas usually include several legs that support the table a desired distance above the earth and in proximity to the chair surrounding the table. A large pole extends from the legs upwardly above the table so as to support an umbrella thereabove. In certain circumstances, the umbrella can be fixed or foldable. The umbrella effectively provides shade to those dining at the table so as to enhance the comfort of such persons at the table.

It is often the common problem in warm areas that the umbrella does not provide a sufficient cooling effect to those persons at the table. Although shade is important in enhancing one's comfort while dining and/or drinking, elevated ambient temperatures can also create a discomfort. Additionally, if there is no breeze, insects can often provide discomfort to persons at the table. Many existing table umbrella apparatus ineffectively provide a full range of services and environmental effects to those at the table.

Various items have been employed in the past with outdoor patio activities. In particular, electric fans have been used as a source of air for those sitting outside. Electric fans commonly use an electric motor with fan blades attached to the shaft of the rotor of the motor such that the electric motor is positioned central to the fan blades. Unfortunately, when the electric fan is used outside, it does not provide a great deal of protection from the sun nor a full range of comfort to those sitting at tables.

In the past, various patents have issued relating to fan assemblies and environmental control apparatus associated with table umbrellas. For example, U.S. Patent Publication No. 2002/0096203, published on Jul. 25, 2002 to Cohen et al., describes a fan assembly for a table umbrella. A motor assembly is connected to the pole that supports the table umbrella. A rather complicated arrangement of drive rings allows the umbrella to rotate relative to the table by the action of the motor.

U.S. Patent Publication No. 2002/0121296, published on Sep. 5, 2002 to R. B. Copple, describes an integrated electric fan and patio umbrella. The device uses an electric fan mounted as integral part of a patio umbrella. The umbrella fabric is open at the top so as to expose the fan to direct air from above. The umbrella can be raised and lowered around the fan blades without the need to hinge the blades up or down.

U.S. Patent Publication No. 2003/0168091, published on Sep. 11, 2003 also to Cohen et al., describes another type of fan assembly for a table umbrella. The fans are located on the underside of the table umbrella. The fans are driven by a shaft which extends through the table umbrella. As a result, the fans provide an airflow downwardly onto patrons sitting at the table below the umbrella.

U.S. Patent Publication No. 2004/0149325, published on Aug. 5, 2004 to G. G. Kuelbs, shows another type of table umbrella apparatus having an integral lighting system so as to provide relatively bright outdoor light for reading and other activities. The umbrella apparatus also includes a cooling system that utilizes electric fans and misting systems. A motorized retraction system is also used so as to retract or open the umbrella.

U.S. Patent Publication No. 2004/0221882, published on Nov. 11, 2004 to Watson et al., describes an insect repellant structure for use in association with a table umbrella. The system is utilized so as to circulate air, along with an insect repellant, in an area below the umbrella and above the table.

U.S. Patent Publication No. 2005/0105898, published on May 19, 2005 to Bachinski et al., shows an infrared heating systems for patio umbrella. The heating system includes a shroud defining an inner volume and a plurality of electrical infrared heating elements positioned generally downward facing in the inner volume of the shroud.

U.S. Pat. No. 2,727,366, issued on Dec. 20, 1955 to O. A. Hagen, describes sprinkler system attachment for a lawn umbrella. The sprinklers are rotatably mounted at a top of the umbrella so as to deliver a flow of water outwardly therefrom. The water will drain onto the top surface of the umbrella so as to flow downwardly beyond the outer periphery of the umbrella. The downward flow of such water will create a cooling effect for those persons sitting at the table below the canopy of the table umbrella.

U.S. Pat. No. 3,200,820, issued on Aug. 17, 1965 to R. R. Garrett, shows a table umbrella apparatus with a solar energy collector affixed to a top surface thereof. The solar energy collector has a generally convex shape with respect to the table so as to provide for the collection of solar energy therein and also to provide shade and comfort to the persons sitting at the table therebelow.

U.S. Pat. No. 5,007,811, issued on Apr. 16, 1991 to M. H. Hopkins, shows an electric fan for a patio umbrella. A rotatable fan is mounted on the interior of table umbrella above the table. A gear or belt drive system couples to the fan from a motor supported on the pole of the table umbrella. As a result, the fan blades can rotate so as to deliver a flow of air downwardly to those persons sitting at the table.

U.S. Pat. No. 5,025,639, issued on Jun. 25, 1991 to T. D. Thomas, shows a patio table cooler in which a central thermally-insulated container is located below the table. The container is cooled by an ice/chemical coolant or refrigeration coils. An electric fan, associated with the cooling element, is positioned below the table and on the base of the table.

U.S. Pat. No. 5,207,238, issued on May 4, 1993 to Rivera et al., shows an air flow lounge umbrella apparatus which includes a fan system that is located in the base of the table umbrella. The fan system delivers air through the pole associated with the umbrella. Airflow will pass through apertures formed on the pole so as to deliver air outwardly of the pole and to those person sitting at the table.

U.S. Pat. No. 5,868,152, issued on Feb. 9, 1999 to R. C. Brown, describes a rotating patio umbrella fan. A motor is located in the base so as to drive a shaft extending through the pole of the table umbrella. The canopy of the umbrella is connected to shaft so as to be rotatably connected to the motor.

U.S. Pat. No. 5,964,233, issued on Oct. 12, 1999 to Clark et al., provides a patio umbrella with a radiant heater. The heater is affixed to the pole of the table umbrella generally below the umbrella. As a result, the canopy will reflect heat from the heating element downwardly to those sitting at the table.

U.S. Pat. No. 5,979,793, issued on Nov. 9, 1999 to R. J. Louis, provides a self-contained misting device. A container has a support for water therein. An ice chamber is associated with the container so as to allow melted ice to be mixed with the water in the container. A pump delivers the cooled water upwardly and outwardly therefrom to a misting nozzle. The misting nozzle will then deliver a mist in a downward orientation.

U.S. Pat. No. 6,017,188, issued on Jan. 25, 2000 to C. Benton, describes a patio table and fan combination. A fan is mounted to the pole directly below the canopy of the umbrella. A plurality of lights are mounted on the pole so as to deliver lighting toward the table. The fan motor is mounted co-axially with the fan and in close proximity to the underside of the patio umbrella.

U.S. Pat. No. 6,325,084, issued on Dec. 4, 2001 to R. B. Cohen, provides another type of combined umbrella and fan device. Once again, the fan is mounted directly below the underside of the canopy of the umbrella. A motor is affixed to the pole and drivingly connected to the fan blades.

U.S. Pat. No. 6,336,450, issued on Jan. 8, 2002 to J. Collet, provides a terrace heating device. This device has a reflector for reflecting rising heat from a heat downwardly toward person therebelow. The reflector is in the shape of an umbrella-like cover that is articulatable between an open position and a closed position.

U.S. Pat. No. 6,651,647, issued on Nov. 25, 2003 to M. Waters, describes another type of heating apparatus having a slidable shroud. A fuel source is provided in a base of the heating apparatus so as to deliver fuel to a burner assembly positioned generally below a reflector. The reflector is in the form of a shroud which serves to direct heat downwardly therefrom.

U.S. Pat. No. 6,682,000, issued on Jan. 27, 2004 to P. C. Apple, provides a misting umbrella. The misting umbrella includes a pump that is connected to a supply of water. A tube extends from the pump upwardly along a pole associated an umbrella. Conduits extend from the tube outwardly toward the periphery of the umbrella so as to deliver a misting spray downwardly to an area under the fabric cover of the umbrella.

U.S. Pat. No. 6,907,875, issued on Jun. 21, 2005 to Eastman et al., provides an outdoor heater which has a movable table attachment thereto. A fuel supply is located on the underside of the table. A radiant heater is provided generally below a small canopy so as to direct heat downwardly toward the table.

It is an object of the present invention to provide a table umbrella apparatus which provides a breeze and shade to those sitting at the table.

It is another object of the present invention to provide a table umbrella apparatus in which the flow of air can be directed, as desired, to a person sitting below the umbrella.

It is another object of the present invention to provide a table umbrella apparatus in which a cooling flow of air can be delivered outwardly of the table.

It is a further object of the present invention to provide a table umbrella apparatus which can be easily moved and assembled with minimal trouble and difficulty.

It is a further object of the present invention to provide a table umbrella apparatus which can provide a mist to those seated at the table It is still another further object of the present invention to provide a table umbrella apparatus can integrate with other systems so as to provide a complete table assembly.

It is still a further object of the present invention to provide a table umbrella apparatus that can be easily transported.

It is still another object of the present invention to provide a table umbrella apparatus which is easy to assemble, easy to use, relatively inexpensive, and easy to manufacture.

These and other objects and advantages of the present invention will become apparent from the reading of the attached specification and appended claims.

BRIEF SUMMARY OF THE INVENTION

The present invention is an apparatus that comprises a base, a table affixed to the base, a canopy support by the base a distance above the table, and an air treating means positioned in the base. The air treating means serves to deliver a flow of air outwardly of the base.

In the present invention, a plurality of legs are affixed to the base. These legs are pivotal between a first position extending radially outwardly of the base in a generally horizontal plane and a second position juxtaposed against the base in a generally vertical orientation. A pair of wheels are rotatably mounted to the base at a bottom of the base.

The base includes a housing having an interior volume. The table affixed to a top of the housing. The air treating means is positioned in the housing. The air treating means includes a fan positioned in the housing and a motor drivingly connected to the fan such that the fan urges the air outwardly of the housing. A reservoir is positioned in the housing. This reservoir is suitable for receiving a supply of water therein. A pumping means is cooperative with the water in the reservoir for passing a flow of water across the air urged by the fan. Specifically, an aspen wood intake filter is positioned in the housing adjacent to vents formed in the wall of the housing. The pumping means serves to pass water from the reservoir into the aspen wood intake filter. The air is urged by the fan across this intake filter. The aspen wood intake filter can also be formed of other materials so as to be generally absorbent and distributive of water therein. The housing has a door formed in a wall thereof. The reservoir is accessible through this door.

The housing has an air plenum formed therein. The air plenum extends from the fan to a top surface of the table. An airflow outlet is positioned above the surface of the table. The airflow outlet has vents directed in different directions. The airflow outlet comprises a truncated pyramidal structure affixed to the top surface of the table and extending upwardly therefrom. The vents are formed on surfaces of the structure. Each of the vents has adjustable louvers thereon.

The canopy can be a foldable umbrella that is connected to the table by a pole. Alternatively, the canopy can be a non-foldable cover that has a diameter greater than a diameter of the table. The pole can either be permanently affixed to the base and the table or removably connected thereto.

In the present invention, a misting nozzle can be positioned above the table. Another pump can be interconnected between the water reservoir and the misting nozzle so as to deliver water from the reservoir to the misting nozzle.

DETAILED DESCRIPTION OF THE INVENTION

Figure 1:
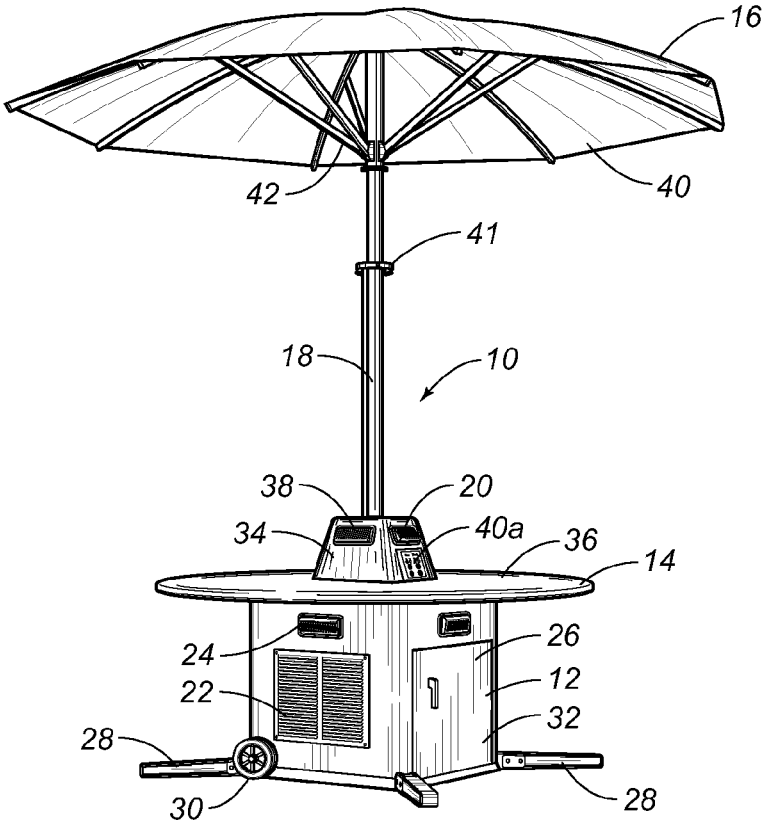
FIG. 1 is a perspective view of the preferred embodiment of the table umbrella apparatus of the present invention.

Referring to FIG. 1, there is shown the table umbrella apparatus 10 in accordance with the preferred embodiment of the present invention. The table umbrella apparatus 10 of the present invention includes a base 12, a table 14 affixed to the base 12, a canopy 16 that is connected by a pole 18 to the table 14 and the base 12, and an air treating means 20 that is positioned within the base 12. The air treating means 20 is suitable for delivering a flow of air outwardly of the base 12.

As can be seen in FIG. 1, the base 12 has a generally cubical configuration. Vents 22 are formed on at least one wall 24 of the base 12. A door 26 is located on another wall of the base 12. The base 12 has legs 28 extending radially outwardly therefrom in a generally horizontal plane. Wheels 30 are rotatably mounted to a bottom of the base 12 generally adjacent to the legs 28. The wheels 30 can be either adjustable upwardly so as to rise above the bottom level of the legs 24 but can be removably connected to the base 12. The table 14 has a generally circular configuration and is mounted to a top surface of the housing 32 of the base 12. The table 14 includes an airflow outlet structure 34 mounted to a top surface 36. There airflow outlet surface 34 includes vents 38 formed on sides of the truncated pyramidal structure of the airflow outlet 34. Vents 38 include suitable louvers thereon so as to allow a person sitting at the table 14 to adjust a flow of air in a desired direction. A control pad 40*a* can also be mounted on one of the surfaces of the structure 34 so as to allow persons at the table 10 the control the flow of air, control lighting associated with the apparatus 10, or to place orders therefrom.

The canopy 16 is in the nature of a foldable umbrella 40. The foldable umbrella is supported by struts 42 extending upwardly from pole 18. The umbrella 40 can be folded in a conventional manner in the nature of a conventional table umbrella apparatus. A misting ring 41 is affixed to the pole 18 in a position below the umbrella 40.

Figure 2:
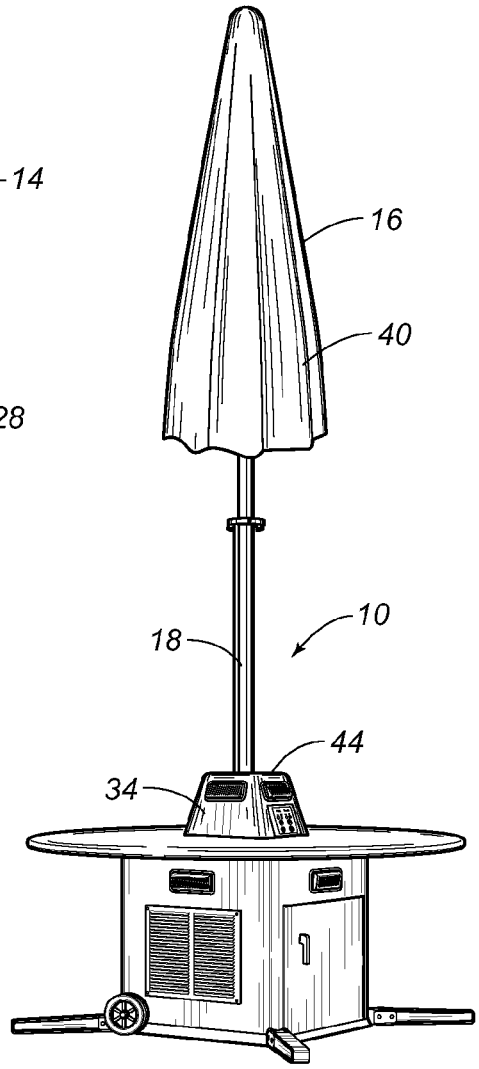
FIG. 2 is a perspective view showing the table umbrella apparatus of the present invention with the umbrella in a folded configuration.

FIG. 2 illustrates the manner in which the canopy 16 has umbrella 40 extending in a generally folded configuration. The pole 18 extends upwardly from the top 44 of the structure 34.

Figure 3:
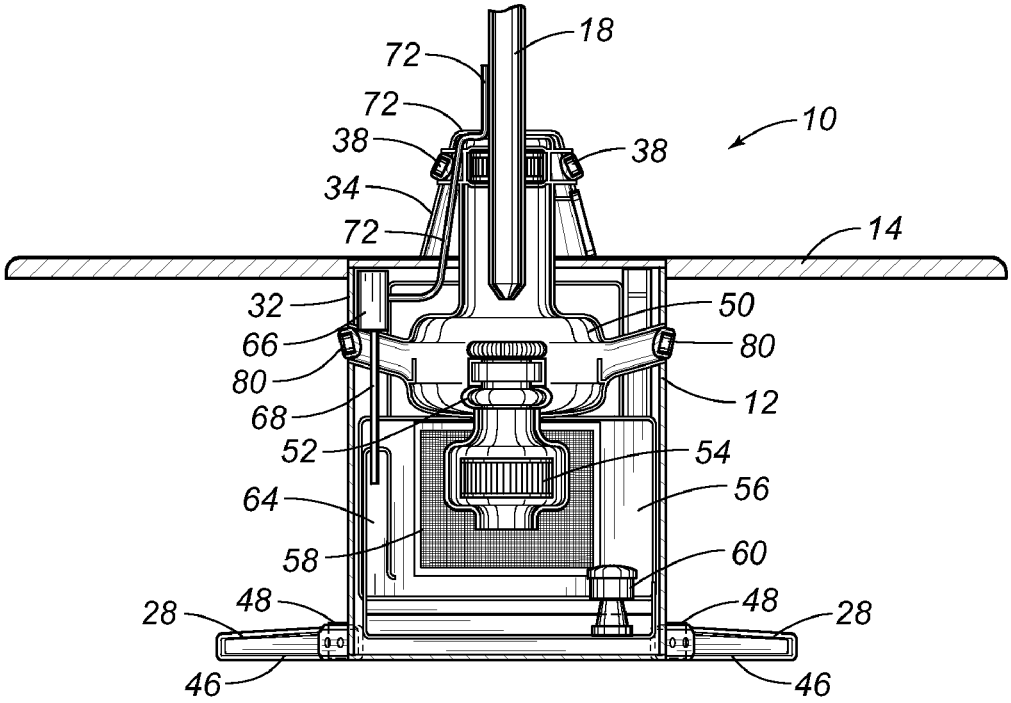
FIG. 3 is a cut-away interior view of the base of the table umbrella apparatus of the present invention.

FIG. 3 shows an interior view of the base 12. As can be seen in FIG. 3, the table 14 is affixed to a top surface of the housing 32 of base 12. The pole 18 is illustrated as being removably received within an interior of the structure 34. In an alternative embodiment of the present invention, the pole 18 can be permanently secured generally centrally of the structure 34.

In FIG. 3, it can be seen that the legs 28 include arms 46 which are connected by locking pins to leg flanges 48. Leg flanges 48 extend outwardly from the bottom of the base 12. The locking pins associated with the leg flanges 48 can be removed so as to allow the leg members 46 to be removed or can be adapted so as to allow for a pivoting of the leg members 46 with respect to the leg flanges 48.

In FIG. 3, it can be seen that there is an air plenum 50 that is formed generally centrally of the base 12. Air plenum 50 will extend from the interior of the base 12 upwardly through the table 14 to the interior of the structure 34. Vents 38 communicate with air plenum 50 so as to allow air to flow outwardly through the air plenum 50 and through the louvers associated with vents 38.

A motor 52 is mounted in the base 12 generally centrally in the base and within air plenum 50. Motor 52 is drivingly connected to fan 54. The fan 54 is a squirrel cage fan that is also mounted generally centrally of the base 12. Fan 54, along with motor 52, is arranged so as to draw air inwardly of the base 12 through the vents 22 located on wall 24 of the base 12. A reservoir 56 is received on the interior of the base 12. The reservoir 56 is suitable for receiving a supply of water therein. An aspen wood intake filter 58 is positioned on the interior of the vents 22 so as to allow air passing through inwardly of the base 12, through the vents 22, to pass through the aspen wood intake filter 58. A pump 60 is mounted in the base 12 so as to pass water from the reservoir 56 upwardly and into the top of the aspen wood intake filter 58 so as to allow the water to pass, by osmosis, through the porous wood associated with the aspen wood intake filter 58. As used herein, the preferred embodiment is an aspen wood intake filter. However, various other types of porous, absorbent and distributive intake surfaces can be utilized in place of the aspen wood intake filter 58. Within the concept of the present invention, it is important that the intake filter 58 be suitably porous and absorbent so as to allow air to pass therethrough while retaining downwardly flowing water therein. Slowly, the water will drop through the structure of the intake filter 58 so as to be collected at a bottom of the reservoir 56. The pump 60 can then redeliver and recirculate the water back to the top of the interior of the intake filter 58.

In normal use, the motor 52 will rotate the fan 54 so as to draw air through the intake vents 22 and across the intake filter 58. This action causes the air to be cooled by the evaporative action. The air then passes from the fan 54 upwardly into the air plenum 50 and outwardly through vents 38 located at the top of table 14 and the vents 62 located below the table 14. As a result, the present invention effectively allows for the delivery of cooled air to those persons sitting at the table 14.

as can be seen in FIG. 2, the preferred embodiment of the present invention utilizes an evaporative/swamp cooler apparatus. The swamp cooler includes a reservoir that holds the water for circulation over saturation intake vents/filters (the aspen wood filters). Air is cooled as it is drawn in by way of strategically mounted squirrel cage fan. As the air passes over the water-saturated filters, moisture or humidity is added to the air so as to cool the air temperature by as much as twenty percent in dry climates. Swamp cooling is preferred method of cooling because it provides some comfort as opposed to the use of more expensive air conditioning equipment. This humidified air is distributed by way of the squirrel cage fan so as to direct the air straight upwardly into the plenum. The plenum pressurizes the air for distribution to the louvered vents so as to allow for control and distribution for under the table and at head height (by way of the control consol). The vents provide total direction control, as well as shut off, so as to allow each individual the ability to control their own personalized climate. The intake air filters are made to be easily removed or replaced for maintenance. In order to remove the intake filters for maintenance, it is only necessary to open the external cowl door and simply slide out the filters and replace with new filters. The aspen wood filters allow for easy saturation and distribution of the humidified air. The exterior door allows easy access to the swamp cooler by way of a key latch assembly that keeps unwanted entry from occurring. The swamp cooler provides another air-tight sealed entry door so as to allow water to be filled, ice to be added (for more effective cooling) and for maintenance of the recirculation pump. The recirculation pump continually circulates and recirculates reservoir water over the wood filters by way of drip nozzles that are strategically positioned over the top of the filters. The drip nozzles provide continuous water saturation to the filters by way of the reservoir recirculation pump. This recirculation pump can be a common fountain pump.

In FIG. 3, it can be seen that there is an auxiliary reservoir 64 formed on the interior of the base 12. Another pump 66 is connected by pipe 68 to the auxiliary reservoir 64. Pump 66 serves to deliver the water from the reservoir 56 upwardly to misting nozzle located on the structure 34. As a result, when desired by occupants of the table umbrella apparatus 10, proper misting functions can be achieved. The tube 72 can also, or alternatively, extend along the pole 18 so that the mist can be delivered from a location just below umbrella.

Figure 4:
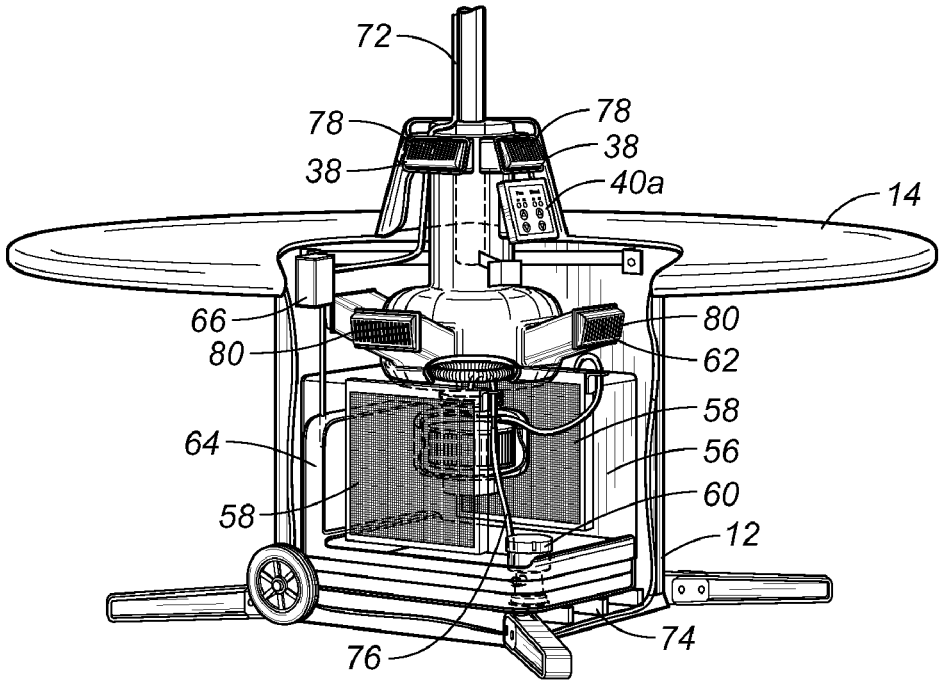
FIG. 4 is another cut-away view of the base associated with the table umbrella apparatus of the present invention.

FIG. 4 also shows the interior of the base 12. In FIG. 4, it can be seen that the reservoir 56 has a generally cubical shape that is supported by structural elements 74 located above the bottom of the base 12. Pump 60 is mounted at the bottom of the reservoir 56 so as to deliver water upwardly through conduit 76 to the top of the aspen wood intake filters 58. It can be seen that the aspen wood intake filters 58 are located on opposite sides of the base 12. Suitable vents, such as vents 22 as illustrated in FIG. 1, can also be formed on the opposite wall of the base 12.

In FIG. 4, it can be seen that the pump 66 is connected to the auxiliary reservoir 64 so as to deliver a mist through tube 72 to a nozzle located upwardly above the table 14. FIG. 4 also shows the control panel 40*a* as located in a desired position so that a person sitting at the table 14 can control a flow of air and/or mist from the apparatus 10 of the present invention. Louvers 78 are mounted on the vents 38 so as to allow the user to direct the flow of air delivered thereto. It can also be seen that there are louvers 80 associated with the vents 62 located below the table 14.

Figure 5:
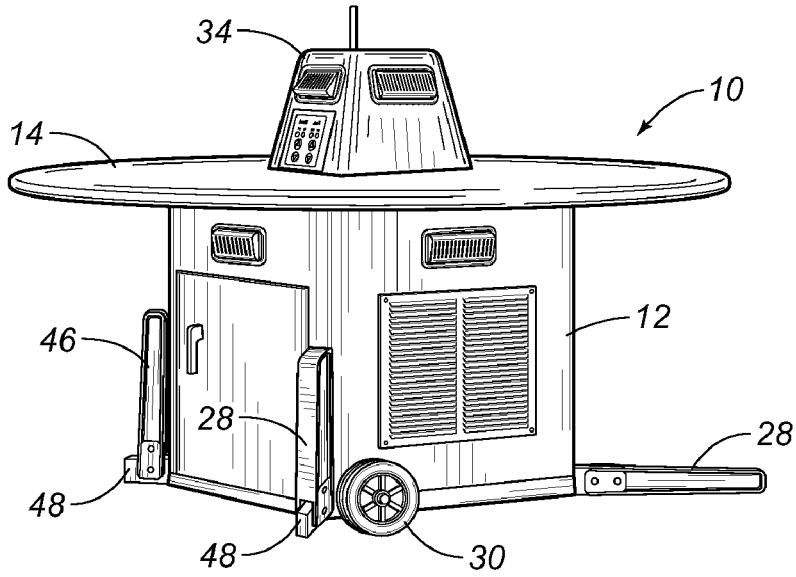
FIG. 5 is a perspective view showing the foldability of the legs associated with the base of the table umbrella apparatus of the present invention.

FIG. 5 shows the manner in which the apparatus 10 can be easily folded for transport and/or storage. In FIG. 5, it can be seen that the legs 28 are movable between a first position which is in a generally horizontal plane located at a bottom of base 12 to a position extending in a generally vertical orientation juxtaposed against a surface of the base 12. In particular, it can be seen that leg 28 has been pivoted upwardly such that the leg member 46 extends at a 90° angle with respect to the leg flange 48. The wheel 30 is now in a position so that the apparatus 10 can be transported by simply tilting the table 14 to an angle slightly removed from horizontal. A splash reservoir can be contained within the interior of the base 12 so as to avoid any spilling of liquid from the reservoir therein. In FIG. 5, it can further be seen that the pole 18 associated with the canopy 16 has been removed from the interior of the structure 34. The umbrella 40 can be simply folded in a conventional manner and stored with the table 14 and the base 12 in a convenient and simple manner.

Figure 6:
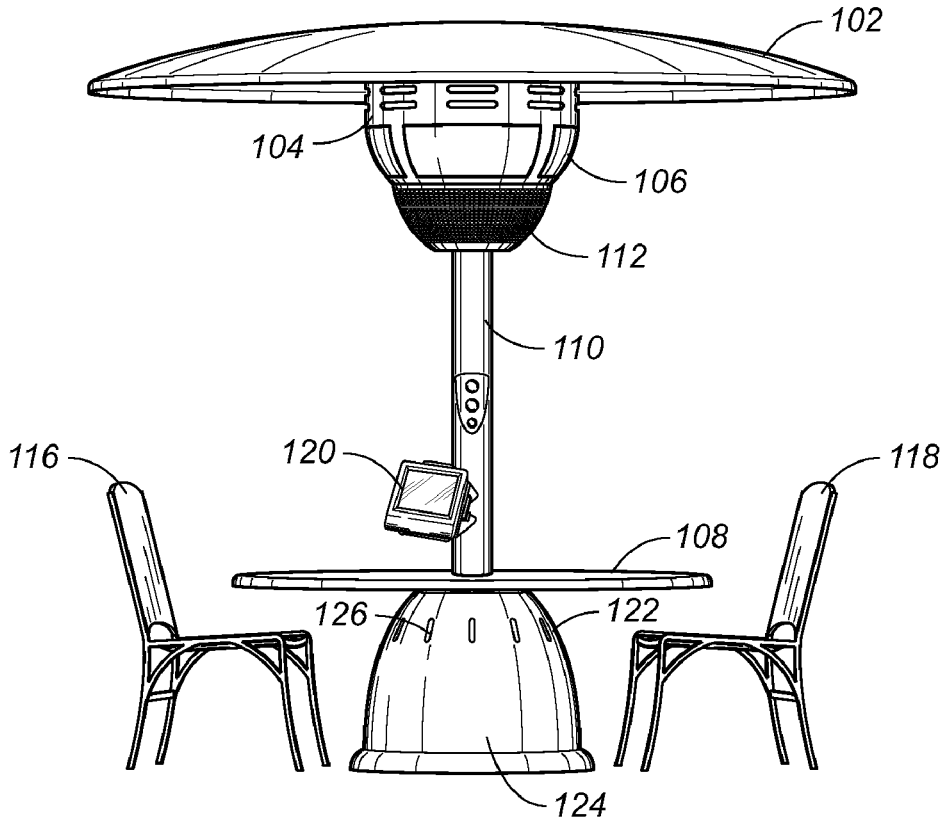
FIG. 6 is a side elevational view of a first alternative embodiment of the table umbrella apparatus of the present invention.

FIG. 6 shows an alternative embodiment of the table umbrella apparatus 100 of the present invention. In FIG. 6, it can be seen that the canopy 102 has a generally fixed and permanent structure. A convection heating element 104 is located just below the canopy 102. Lighting system 106 is positioned below the convection heating element 104 so as to able to light downwardly toward the table 108 at the opposite end of pole 110. Speakers 112 can be provided by way of the lighting 106 system so that sound, music, announcements or interactive ordering can be carried out from the table 108. A suitable misting ring can be positioned generally below the speakers 112. Individually timed on/off switches 114 are affixed to the pole 110 at a convenient location for persons sitting at chairs 116 and 118 of the table 108. An order automation internet portal 120 is affixed to the bottom of the pole 110 above the top surface of the table 108. This allows persons sitting at the chairs 116 and 118 to place orders for food and/or drinks. The table 108 has a generally circular configuration. The base 122 is positioned below the table 108. Base 122 includes access door 124 which allows access to the components therein. Vents 126 serves to deliver air outwardly of the base 122 in the manner described in association with the previous embodiments of the present invention.

In the embodiment of the apparatus 100 of the present invention, order automation and digital dining is provided with touch screen credit card portal 120 so as to allow for easy and quick order processing from the menu presented from the screen of the portal 120. An entertainment portal will allow for internet access for gaming and business. A digital jukebox can also be provided at the table umbrella apparatus 100 through the portal 120. The canopy 102 can be suitably rigid so as to allow for the placement of solar panels thereon in order to provide a fossil fuel-free source of energy. The portal 120 can include a keyboard and be either wireless or wired.

Figure 7:
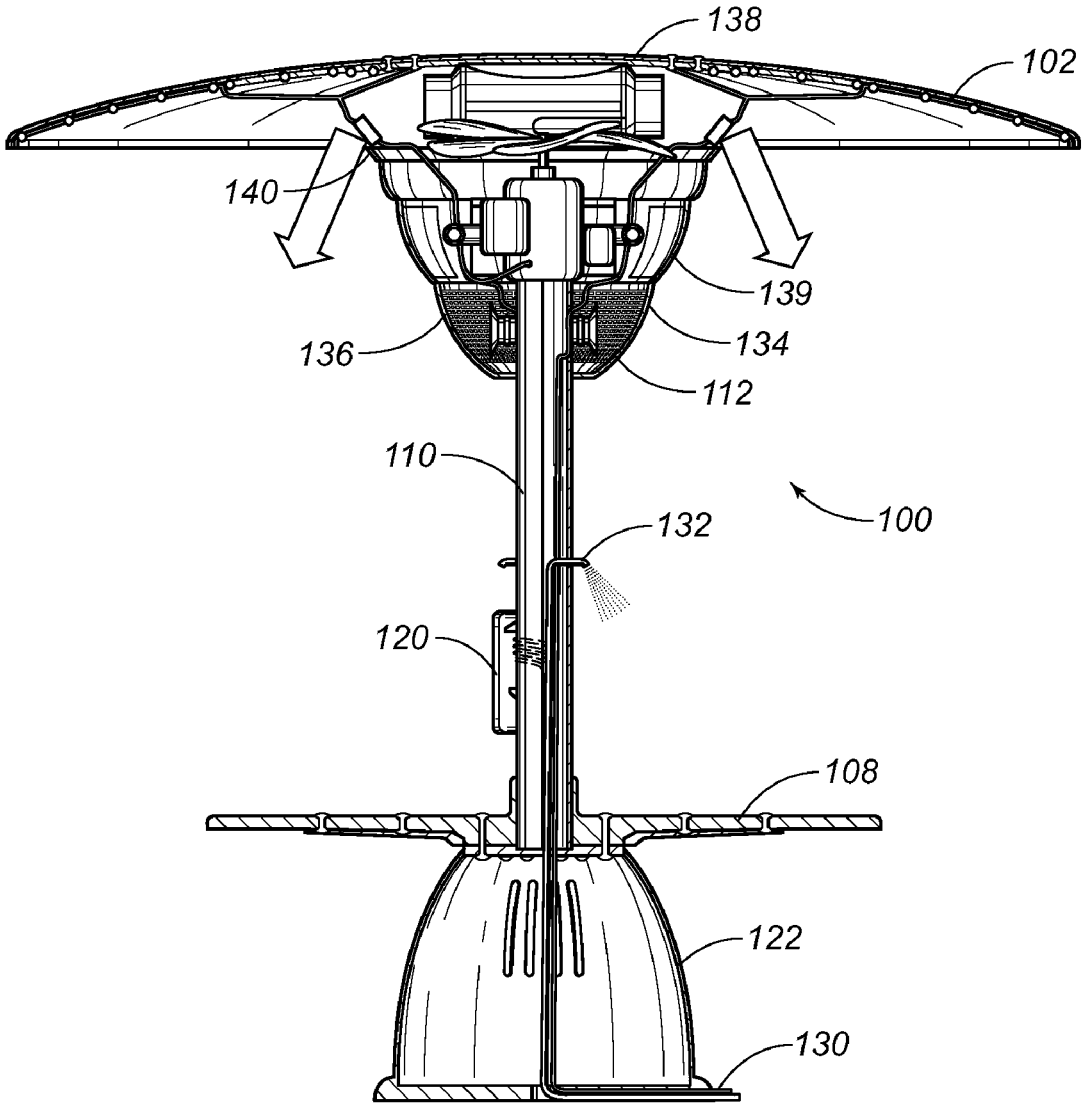
FIG. 7 is a cut-away view of a modified form of the first alternative embodiment of the table umbrella apparatus of the present invention.

FIG. 7 shows the apparatus 100 and, in particular, shows the misting system associated therewith. In FIG. 7, it can be seen that the base 122 includes a permanent connection to a source of water through a tube 130. Tube 130 can extend through a bottom of the base 122 so as to deliver water upwardly therefrom. The tube 130 is connected to misting nozzles 132 located above the table 108. As such, through the use of controls associated with portal 120, the user of the apparatus 100 can control the action of the misting nozzle 132.

The mist system will include a pump, a mist line and two or three mist nozzles. This mist system can provide additional cooling. A mist ring is provided to mount or secure and remove the mists nozzles to any umbrella post. The ring attaches by way of set screws for easy attachment and removal. The mist nozzles are directly connected to a mist line that sources water from the swamp cooler reservoir. The mist system distributes on demand by way of the control consol button. The pump is preferably of a drive mist type (100 p.s.i. or greater). The system can be wired to a timed delay relay circuit so that it runs at specific timed control intervals and automatically resets for the next use. Water must be added to the swamp cooler reservoir so as to provide the water to the mist system.

In FIG. 7, it can be seen that speakers 112 deliver sound through the housing 134 extending therearound. Another motor 136 is mounted within the lighting system 139. Motor 136 can be connected to an electrical line extending through the interior of pole 110. The motor 136 is drivingly connected to a fan 138 located just below the canopy 102. As a result, the fan 138 can deliver a flow of air outwardly through vents 140 located just below the interior surface of the canopy 102. The lighting system 139 is in the form of a tubular bulb located in the upper cowl so as to provide soft lighting. Also, yellow lighting can also be used so as to repel bugs. Additional lighting can be available, as desired.

Figure 8:
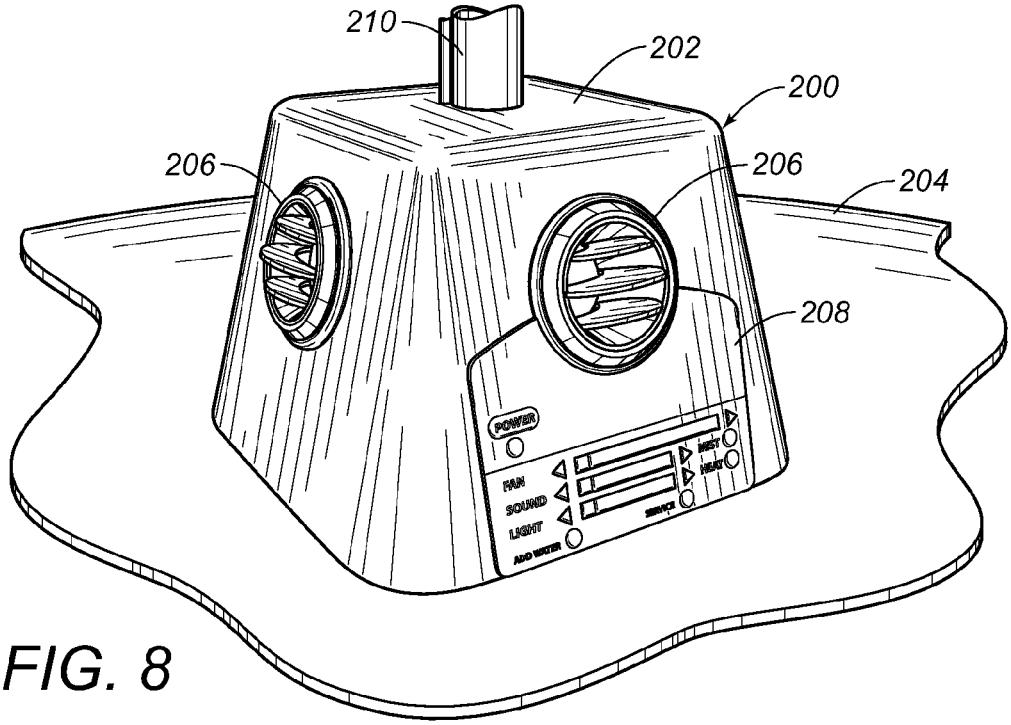
FIG. 8 is a perspective view of one form of the air outflow structure associated with the table umbrella apparatus of the present invention.

FIG. 8 illustrates a detailed view of the air outflow structure 200. The air outflow structure is in the form of a housing 202 mounted on the top of the table 204. Several louvered vents 206 are positioned on the various faces of the housing 202. A control panel 208 is positioned on the housing 202 so as to allow users to control the operation of the system associated with the table umbrella apparatus of the present invention and also to monitor the condition of the motor, the water and the power supplied with the table umbrella apparatus of the present invention. An umbrella receptacle 210 is provided at the top of housing 202. The umbrella receptacle 210 allows for any umbrella to be easily inserted and/or removed from the housing 202. The umbrella receptacle 210 includes a removable metal receptacle tube that mounts via a quick connect coupling assembly (located just above the plenum) that facilitates the assembly and disassembly for shipping purposes. The coupling is of the quick connect type with an easy thread release. The support tube coupling is strategically mounted to welded cross bars in the exact center of the unit to provide stability to the umbrella. Once the receptacle tube 210 is attached, any umbrella will fit in the tube securely.

The control panel 208 is of the membrane switch type. Membrane switch technology provides safety in that no AC current is at the switch. DC switching capability is all that is necessary to open and close circuitry in the panel 208. The panel itself is made of reinforced material providing tamper-resistant buttons and a whether-resistant panel. A circuit board is provided and mounted securely in the housing 202 so as to provide a safe and effective voltage conversion box necessary to allow the control panel 208 to run and control utilities properly.

Figure 9:
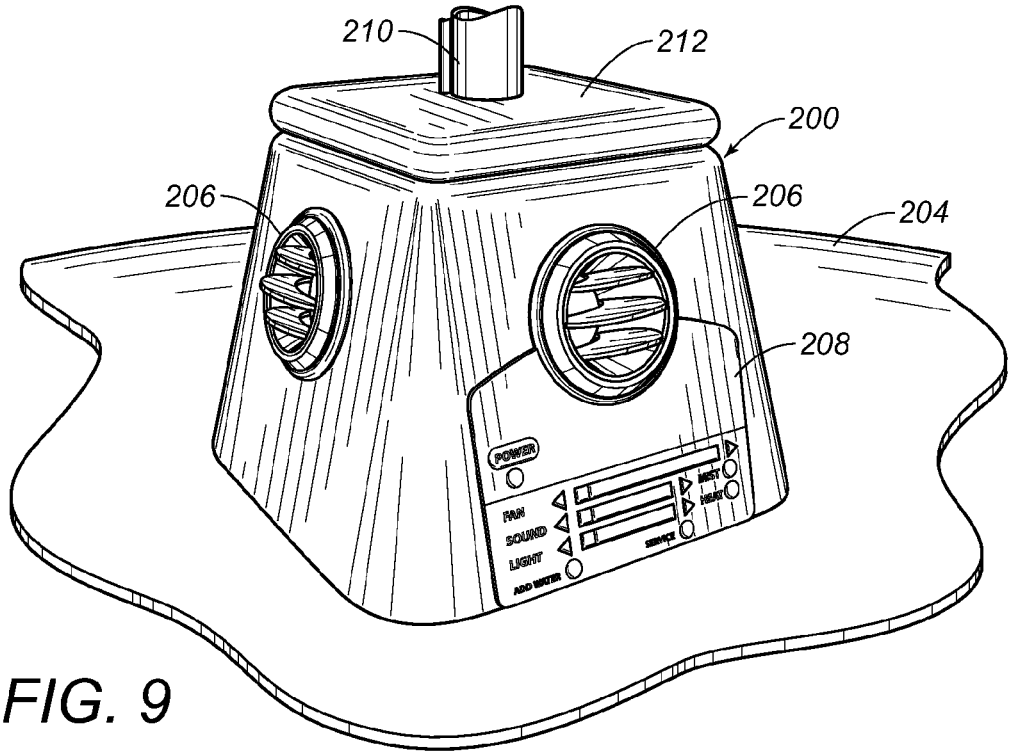
FIG. 9 is a perspective view of another form of the air flow outlet structure of the table umbrella apparatus of the present invention.

FIG. 9 shows the housing 202 of the air flow outlet structure 200 having a lighting element 212 positioned on the top of the housing 202. The lighting 212 can come in many forms. The preferred form is located on or in the air flow outlet structure 200. One method of delivery would be to use small halogen bulbs that are positioned downward at ones plate or menu. The other may be in the form of an ultraviolet-type round bulb that is extension of the housing 202 and is made of white plastic. These lights are controllable by control panel 208 and allow for dimming by way of the control panel 208. An extension of the light bulb provides an on/off blinking order attention button such that, when invoked, the light would blink so as to signal a waitress or waiter. Additionally, the bulb 212 can be provided so as to repel insects. For example, it may be a yellow bug deterrent light bulb.

Figure 10:
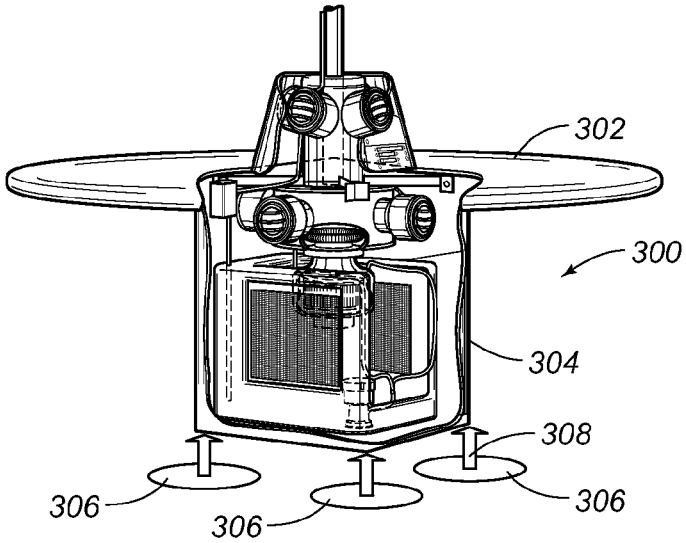
FIG. 10 shows a second alternative embodiment of the table umbrella apparatus of the present invention having rotatably adjustable feet.

FIG. 10 shows a second alternative embodiment 300 of the present invention. Embodiment 300 shows the table 302 and the housing 304 as supported by a plurality of adjustable feet 306. Each of the feet 306 includes threaded portions 308 which allows each of the feet 306 to engage a complementary thread structure formed in the bottom of the housing 304. These feet 306 provide additional stability to the table umbrella apparatus 300 and allow for easy leveling of the table 302. The leveling occurs when the feet 306 is rotated so as to allow for the screw to spin clockwise or counter-clockwise and adjust to allow for the leveling of the table. This is important in outdoor patio environments where the surface may be uneven. This also serves to prevent annoying table rocking. These feet 306 also provide additional stability to the housing 308 and to the table 302 by adding circumferential area to the bottom of the base.

Figure 11:
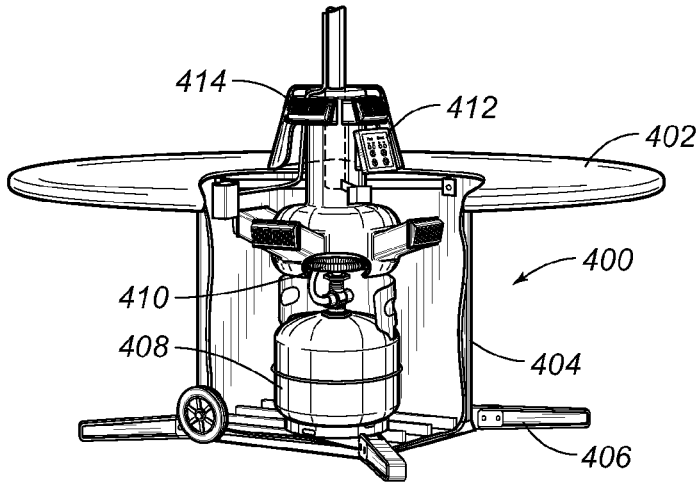
FIG. 11 is a partially cut away perspective view of a third alternative embodiment of the present invention showing the table umbrella apparatus with a propane heater.

FIG. 11 shows a third alternative embodiment 400 the table umbrella apparatus of the present invention. In the table umbrella apparatus 400, the table 402 is mounted on the base 404. Base 404 is supported by feet 406 extending radially outwardly therefrom. In this embodiment a propane tank 408 is positioned on the interior of the base 404 in place of the air conditioning system. The propane tank 408 replaces the reservoir so as to allow radiant heat to be incorporated and the apparatus 400 to be a "heat only" system. A radiant heat ring 410 can be incorporates within the base 404 and resides in the plenum for protection. The heat is controllable by the control panel 412 located on the air outflow structure 414. The controllable heat is directed from under and from mid table by way of control panel 412. Additionally, heat can be delivered to the head by way of the louvered vents formed on the air outflow structure 414. Additionally, heat can be delivered by radiant heating or by convective heating. The present invention can utilize a heat element in the form of a convective coil positioned in the plenum so as to provide evenly distributed heat to all of the vents. The heat can be controlled by way of a thermostat located in the vents. The control panel 412, which controls the fan speed, and the vents can be controlled so as to close or redirect the heat.

Figure 12:
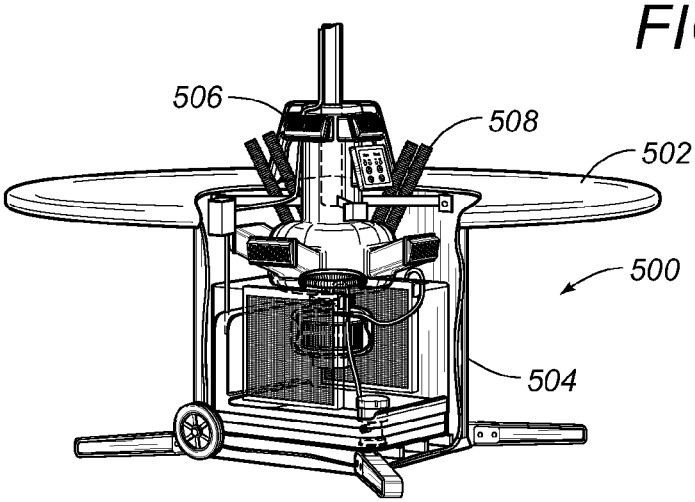
FIG. 12 is a fourth alternative embodiment of the present invention showing the table umbrella apparatus with heating elements and glove warmers.

FIG. 12 shows a fourth alternative embodiment 500 the table umbrella apparatus of the present invention. The table umbrella apparatus 500 includes a base 504, and an air outflow structure 506. In this embodiment, heat is provided from the base 504 so as to deliver air outwardly through the ski glove warmer tubes 508. These tubes 508 will extend to the plenum so that heat passing into and through the plenum will pass outwardly through the tubes 508. Gloves can be easily placed over these tubes so as to warm the gloves and to dry the gloves.

Figure 13:
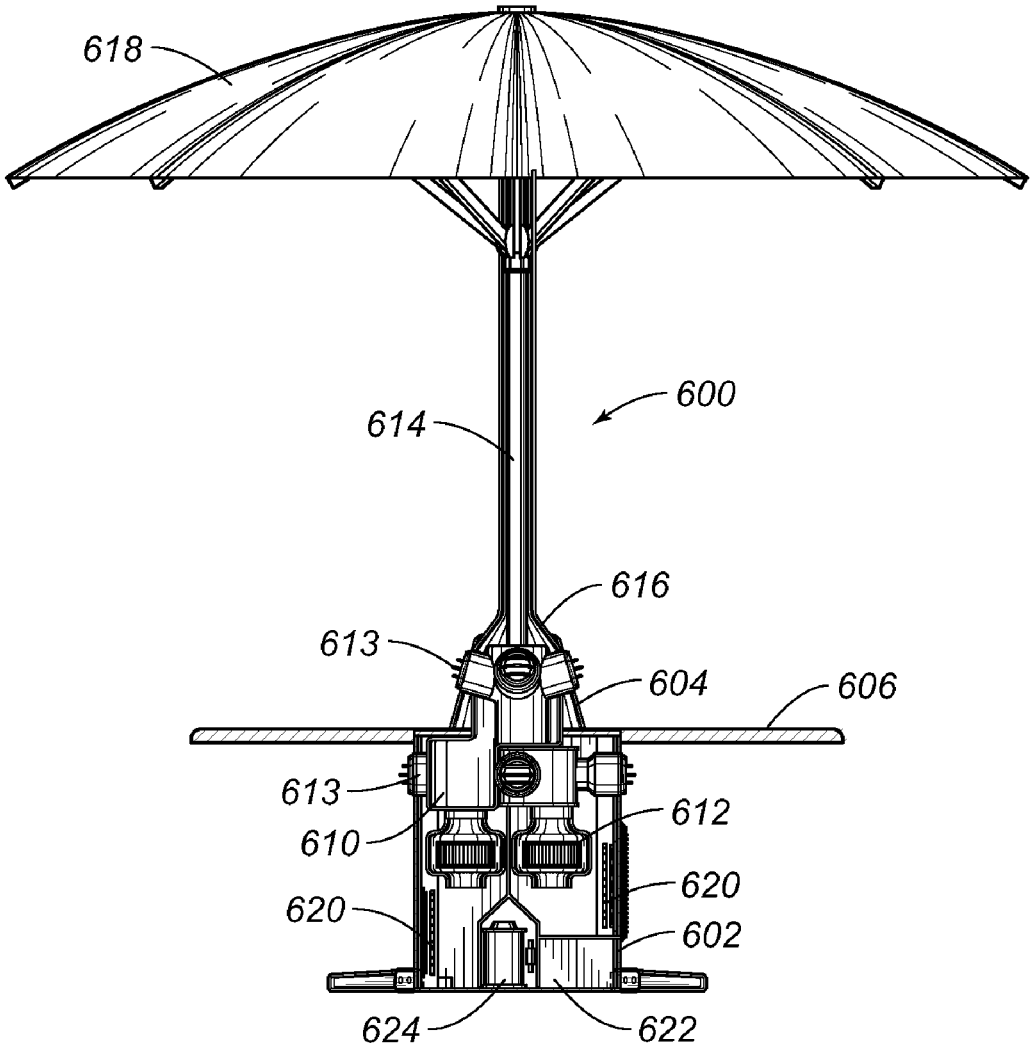
FIG. 13 is a fifth alternative embodiment of the present invention showing, the table umbrella apparatus with an air-conditioning unit as the air treating mechanism.

FIG. 13 shows fifth alternative embodiment 600 of the table umbrella apparatus of the present invention. The table umbrella apparatus 600 includes a base 602, an air outflow structure 604, a table 606 and an umbrella 608. The table 606 is placed upon the base 602. The air outflow structure 604 allows air to flow outwardly above and below the surfaces of the table 606 in a manner described hereinbefore previously. An air plenum 610 is provided within the base 602 so as to allow air to be properly distributed to the various louvered vents 613 located on the air outflow structure 604 and in the base 602 in the area below the table 606.

Importantly, in FIG. 13, an air-conditioning unit 612 can be mounted in place of or complementary to the evaporative/swamp cooler of the earlier embodiments of the present invention. The air-conditioning unit 612 includes a pump, evaporative and condensing coils and suitable plumbing for both heat and water produced by the air-conditioning process. The air-conditioning output from the air-conditioning unit 612 will flow through the same vent system as depicted in the previous embodiments of the present invention. The water that is created and the heat that is generated by the air-conditioning unit 612 can be plumbed through a drain or piped away from the base 602 by way of the depicted umbrella support tube 614. Heat generated by the heat exchanger will be forced upwardly through the supports post 616 for the support tube 614 and out of the top 618 of the umbrella 608. It should be noted that generated water can be collected for use with the mist reservoir as used in the misting system of the earlier embodiment of the present invention.

In FIG. 13, it can be seen that the evaporative and condensing coils 620 are illustrated on either side of the base 602. A water trap reservoir 622 is located under the coils 620. An air intake pump and an extract pump are located in side-by-side relationship within base 602. A Freon exchange unit 624 is located centrally in the bottom area of the base 602.

In the embodiment 600 of the table umbrella apparatus of the present invention, the air-conditioning 613 can pump cooled air through the air plenum 610 and outwardly through the various louvered vents 612. Suitable controls on the air outflow structure 604 will allow the user to properly adjust the cooling effect created by the air-conditioning unit 612 of the present invention.

The present invention also can have various other features. In particular, a rotatable "lazy Susan" food condiment holder can be placed on the tables. Additional sun protection can be achieved in the form of a drop-down blind, by retractable awnings, by tilting umbrellas and by other means that would add additional sun protection during sunset or sunrise. The table top can include fold-down leafs so as to allow the apparatus to be more mobile and easier to load and stack. These leafs would be supported by commonly-used table leaf hinges and brackets. It is also possible, within the concept of the present invention to add a non-toxic bug repellant to the water reservoir so as to enhance mosquito control for the apparatus. A scent, in the form of a liquid, can also be added to the reservoir water so as to distribute a scent as the intake vents get saturated. Another form of scent delivery can be controlled by the control panel where a scent dispensing unit (mounted in the plenum or vent system) can be utilized for on-demand dispensing.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An apparatus comprising:

a base;

a table affixed to said base;

a canopy supported by said base a distance above said table; and an air treating means positioned in said base, said air treating means for delivering a flow of air outwardly of said base, said air treating means comprising:

a fan positioned in said housing;

a motor drivingly connected to said fan such that said fan urges said air outwardly of said housing, said housing having an air plenum formed therein, said air plenum extending from said fan to a top surface of said table; and an airflow outlet positioned above said top surface, said airflow outlet having vents directed in different directions, said airflow outlet comprising a truncated pyramidal structure affixed to said top surface of said table and extending upwardly therefrom, said vents formed on a surface of said structure, each of said vents having adjustable louvers thereon.

2. The apparatus of claim 1, further comprising:

a plurality of legs affixed to said base, said plurality of legs being pivotable between a first position extending radially outwardly of said base in a generally horizontal plane and a second position juxtaposed against said base in a generally vertical orientation.

3. The apparatus of claim 1, further comprising:

a pair of wheels rotatably mounted to said base at a bottom of said base.

4. The apparatus of claim 1, said base comprising a housing having an interior volume, said table affixed to a top of said housing, said air treating means positioned in said housing.

5. The apparatus of claim 1, said air treating means further comprising:

a reservoir positioned in said housing, said reservoir suitable fur receiving a supply of water therein; and a pumping means cooperative with the water in said reservoir for passing a flow of water across the air urged by said fan.

6. The apparatus of claim 5, said housing having vents formed in a wall thereof, the apparatus further comprising:

an aspen wood intake filter positioned in said housing adjacent said vents, said pumping means for passing water from said reservoir into said aspen wood intake filter, the air being urged by said fan across said aspen wood intake filter.

7. The apparatus of claim 1, said air treating mean being a heater mounted in said base so as to deliver heated air outwardly of said base.

8. The apparatus of claim 1, said air treating means being an air-conditioner mounted in said base so as to delivery air outwardly of said base.

9. The apparatus of claim 1, said canopy comprising:

a foldable umbrella; and a pole extending from said foldable umbrella to said table, said pole having an end opposite said foldable umbrella detachably received in said base.

10. The apparatus of claim 1, said canopy comprising:

a cover having anon-foldable configuration, said cover having a diameter greater than a diameter of said table; and a pole having one end affixed to one end of said cover and an opposite end affixed to said base.

11. The apparatus of claim 1, further comprising:

a reservoir positioned in said base, said reservoir suitable for receiving water therein;

a misting nozzle positioned above said table; and a pumping means interconnected between said reservoir and said misting nozzle, said pumping means for delivering water from said reservoir to said misting nozzle.

* * * * *